US009245418B2

(12) United States Patent
Mitchell et al.

(10) Patent No.: US 9,245,418 B2
(45) Date of Patent: Jan. 26, 2016

(54) MULTIPLE GAME GAMING MACHINE

(75) Inventors: Peter Mitchell, Lane Cove (AU); William George Cormack, Lane Cove (AU); Chi We Chim, Lane Cove (AU)

(73) Assignee: ARISTOCRAT TECHNOLOGIES AUSTRALIA PTY LIMITED (AU)

( * ) Notice: Subject to any disclaimer, the term of this patent is extended or adjusted under 35 U.S.C. 154(b) by 27 days.

(21) Appl. No.: 12/614,049

(22) Filed: Nov. 6, 2009

(65) Prior Publication Data

US 2010/0048289 A1 Feb. 25, 2010

Related U.S. Application Data

(63) Continuation of application No. 10/547,684, filed as application No. PCT/AU2004/000260 on Mar. 1, 2004, now Pat. No. 8,182,332.

(30) Foreign Application Priority Data

Mar. 3, 2003 (AU) ..... 2003900993

(51) Int. Cl.
*A63F 9/24* (2006.01)
*G07F 17/32* (2006.01)

(52) U.S. Cl.
CPC ..... *G07F 17/3262* (2013.01); *G07F 17/32* (2013.01); *G07F 17/3267* (2013.01)

(58) Field of Classification Search
CPC ..... G07F 17/3267; G07F 17/3262; G07F 17/3258; G07F 17/326
USPC ..... 463/16–20, 25, 30
See application file for complete search history.

(56) References Cited

U.S. PATENT DOCUMENTS

| | | | | |
|---|---|---|---|---|
| 5,816,914 | A | 10/1998 | Wichinsky | |
| 5,890,962 | A * | 4/1999 | Takemoto | 463/20 |
| 5,980,384 | A | 11/1999 | Barrie | |
| 6,048,267 | A | 4/2000 | Winchinsky | |
| 6,129,357 | A | 10/2000 | Wichinsky | |
| 6,132,311 | A | 10/2000 | Williams | |
| 6,159,095 | A | 12/2000 | Frohm et al. | |
| 6,203,428 | B1 | 3/2001 | Giobbi et al. | |

(Continued)

FOREIGN PATENT DOCUMENTS

| | | | |
|---|---|---|---|
| AU | 5502600 | A | 3/2001 |
| AU | 5529401 | A | 11/2001 |

(Continued)

OTHER PUBLICATIONS

International Search Report, PCT/AU2004/000260, dated Apr. 15, 2004.

*Primary Examiner* — Steve Rowland
(74) *Attorney, Agent, or Firm* — McAndrews, Held & Malloy, Ltd.

(57) ABSTRACT

A gaming machine comprises a display and a game controller arranged to control images of symbols displayed on the display. The game controller is arranged to play a game wherein at least one random event is caused to be displayed on the display and, if a predefined winning event occurs, a prize is awarded. A plurality of sub-games constitute the game displayed on the display. As an initial display, fewer than a full set of images of each of the sub-games are displayed to show a partial outcome of the game, the fewer than the full set of images being representative of a determination of an expected value for each of the sub-games.

8 Claims, 10 Drawing Sheets

(56) References Cited

U.S. PATENT DOCUMENTS

| | | | | |
|---|---|---|---|---|
| 6,312,334 | B1 | 11/2001 | Yoseloff | |
| 6,331,143 | B1 | 12/2001 | Yoseloff | |
| 6,334,614 | B1 | 1/2002 | Breeding | |
| 6,379,245 | B2 | 4/2002 | De Keller | |
| 6,656,040 | B1 * | 12/2003 | Brosnan et al. | 463/16 |
| 6,695,695 | B2 | 2/2004 | Angel | |
| 6,860,810 | B2 * | 3/2005 | Cannon et al. | 463/20 |
| 7,156,741 | B2 * | 1/2007 | Hornik et al. | 463/40 |
| 2002/0002073 | A1 * | 1/2002 | Montgomery et al. | 463/13 |
| 2002/0077167 | A1 * | 6/2002 | Merari | 463/13 |
| 2002/0183105 | A1 * | 12/2002 | Cannon et al. | 463/16 |
| 2003/0054877 | A1 | 3/2003 | Baerlocher | |
| 2003/0069068 | A1 * | 4/2003 | Kaminkow | 463/25 |
| 2003/0092476 | A1 * | 5/2003 | Fox | 463/13 |
| 2003/0214097 | A1 | 11/2003 | Moody | |
| 2004/0072619 | A1 * | 4/2004 | Brosnan et al. | 463/42 |
| 2005/0079908 | A1 * | 4/2005 | Pacey | 463/20 |

FOREIGN PATENT DOCUMENTS

| | | | |
|---|---|---|---|
| CA | 2314669 | A1 | 3/2001 |
| CA | 2405585 | A1 | 11/2001 |
| EP | 1082980 | A2 | 3/2001 |
| EP | 1277178 | A2 | 1/2003 |
| WO | 0182245 | A2 | 11/2001 |
| WO | 2004078297 | A1 | 9/2004 |
| ZA | 200004685 | A | 3/2001 |

* cited by examiner

MULTIPLE GAME GAMING MACHINE

RELATED APPLICATIONS

The present application is a continuation of co-pending U.S. patent application Ser. No. 10/547,684, filed Aug. 30, 2005, which is a National Stage Application of International Application No. PCT/AU04/00260, having an international filing date of Mar. 1, 2004, which claims priority to Australian Patent Application No. 2003900993, filed Mar. 3, 2003, all of which are incorporated herein by reference in their entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

This invention relates to a gaming machine. More particularly, the invention relates to a gaming machine and to an improvement to a game played on such a gaming machine.

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games and/or game features which are popular with the players as a mechanism for improving sales, retaining customers and attracting new customers.

BRIEF SUMMARY OF THE INVENTION

According to a first aspect of the invention, there is provided a gaming machine comprising a display;

a game controller arranged to control images of symbols displayed on the display, the game controller being arranged to play a game wherein at least one random event is caused to be displayed on the display and, if a predefined winning event occurs, a prize is awarded; and a plurality of sub-games constituting the game displayed on the display with, as an initial display, fewer than a full set of images of each of the sub-games being displayed to show a partial outcome of the game, the fewer than the full set of images being representative of a determination of an expected value for each of the sub-games.

An "expected value" is a value based on the probability of obtaining a winning payout and the amount of that payout for each type of prize winning combination of symbols.

The invention is intended particularly for gaming machines displaying reel-type games, commonly referred to in Australia as poker machines and, in the USA, as slot machines. It will, however, be appreciated that the game of the gaming machine could encompass any other type of wagering game such as, for example, a ball-type game (such as keno, pachinko, bingo, or the like).

For ease of explanation, the invention will be described with reference to its application to reel-type wagering games. The reel-type game may be implemented as a video simulation of spinning reels.

Each sub-game may have a plurality of image carrying elements, each of which carries a plurality of images required to be considered in assessing an outcome of the game. The image carrying elements may, for example, be five spinning reels. In this regard, it is to be understood that an image, as referred to above, is the set of three visible symbols of a reel strip which is displayed at any one time as is done conventionally for reel-type games.

In the initial display of each sub-game, fewer than all of the image carrying elements of the sub-games may be displayed to display the partial outcomes of the sub-games.

In the case where the sub-game comprises five reels, for the first sub-game the reel stopping positions of reels 1, 3 and 5 may be determined initially to provide the partial outcome for the first sub-game. The reel stopping positions may be determined in a conventional manner such as by the use of a random number generator (RNG) of the game controller means.

Once the reel stopping positions of reels 1, 3 and 5 of the first sub-game have been determined, the expected value for those reel-stopping positions of the first sub-game may be determined. Thus, the expected value of the first sub-game as derived from the displayed partial outcome of the first sub-game may be used to select the displayed fewer than all of the image carrying elements of the remaining sub-games in the initial display.

The game controller may include a data storage element in which data relating to expected values for each of the remaining sub-games are stored. The data storage element may contain data for the expected values of each possible reel-stopping position of each of the remaining sub-games. The data may be stored in the form of look-up tables for each of the sub-games.

Once the expected value for the first sub-game has been determined, the game controller may access the look-up tables for each of the remaining sub-games to ascertain the expected value for each of the remaining sub-games which most closely approximates the expected value for the first sub-game. It will be appreciated that, in many instances, the expected value for any one of the remaining sub-games may not be exactly the same as that for the first sub-game. In such a case, the expected value most closely approximating that of the first sub-game may be selected for the remaining sub-game by the game controller.

Once the expected values of the remaining sub-games have been selected by the game controller, the reel stopping positions for reels 1, 3 and 5 of the remaining sub-games corresponding to the selected expected values, may be determined.

After the reel-stopping positions for each of the remaining sub-games has been determined by the game controller, reels 1, 3 and 5 of each of the sub-games may then be displayed on the display of the gaming machine.

The positions at which the second and fourth reels of each sub-game are displayed may be left blank.

Prior to any of the sub-games being displayed a player may be required to place a wager. Initially, the wager may be placed on all of the sub-games of the game. When the first, third and fifth reel of each of the sub-games have been displayed, the player may, at the player's option, decide to leave the wager on each of the sub-games or, instead, transfer the total wager to one or less than all of the sub-games with the non-selected sub-game/s then being disabled, for example, by being faded into a background display on the display means.

If all of the sub-games are selected by the player, each sub-game may have its second and fourth reels revealed in a spinning condition which stop to determine whether or not a prize winning combination or combinations has resulted in any of the sub-games. Conversely, if only one or less than all of the sub-games is selected by the player, only the second and fourth reels of the selected games may be revealed and any prize winning combinations in the selected sub-games is paid out.

Each selected sub-game may have a feature game associated with it and, if that feature is won, the feature is also played before the game is concluded. The feature associated with each sub-game may be a no-cost feature. In other words, the player does not have to wager any additional amount to be eligible to participate in the feature of that sub-game.

The feature associated with each sub-game may be triggered by the controller independently of the result of a base sub-game preceding the triggered feature. Thus the feature does not depend on expected values associated with the relevant sub-game.

The features associated with the sub-games may differ from one another. Therefore, as indicated above, each feature may have its own theme, etc.

Further, the game may have a jackpot bonus feature associated with it. The bonus feature may be in the form of a progressive jackpot feature.

The progressive jackpot may be triggered in any of a number of ways. One form of trigger may be a wager-based trigger where, the more that is wagered on the game, the higher the chances are of obtaining the progressive jackpot.

The progressive jackpot may comprise at least two jackpot levels being a minor jackpot and a mega jackpot. When the bonus feature is triggered, an animation may be displayed which indicates to the player which level of jackpot the player will win.

According to a second aspect of the invention, there is provided a gaming machine comprising a display;

a game controller arranged to control images of symbols displayed on the display, the game controller being arranged to play a game wherein at least one random event is caused to be displayed on the display and, if a predefined winning event occurs, a prize is awarded; and the game being in the form of a spinning-reel game and the game controller using a table of expected values to determine displayed reel-stopping positions of less than all of the reels of the game.

The game may comprise a plurality of sub-games, each sub-game being in the form of a spinning reel game in respect of which the game controller uses the table of expected values to determine displayed reel-stopping positions of less than all of the reels of each sub-game.

According to a third aspect of the invention, there is provided a method of playing a wagering game, the method including the steps of generating a partial outcome for a first sub-game of the game;

determining an expected value of an outcome of the first sub-game arising from said partial outcome;

determining partial outcomes for remaining sub-games of the game, the partial outcomes for each of the remaining sub-games being representative of an expected value for each of the remaining sub-games, the expected value for each of the remaining sub-games being approximately the same as the expected value for the first sub-game; and displaying the partial outcomes of the sub-games of the game on a display of a gaming apparatus.

Each sub-game may have a plurality of image carrying elements, each of which carries a plurality of images required to be considered in assessing an outcome of the game and the method may include, in an initial display of each sub-game, displaying fewer than all of the image carrying elements of the sub-games to display a partial outcome of each of the sub-games.

The method may include determining a display configuration, i.e. the reel stopping position of each reel, for the fewer than all of the image carrying elements of the first sub-game to provide the partial outcome for the first sub-game.

In the case where the sub-game comprises five reels, for the first sub-game the reel stopping positions of reels 1, 3 and 5 may be determined initially to provide the partial outcome for the first sub-game. The reel stopping positions may be determined in a conventional manner such as by the use of a random number generator (RNG) of the game controller means.

The method may include, once the display configuration of the partial outcome of the first sub-game has been determined, determining the expected value of the first sub-game. Further, the method may include using the expected value of the first sub-game to select the displayed fewer than all of the image carrying elements constituting the partial outcomes of the remaining sub-games.

The method may include storing data relating to expected values for each of the remaining sub-games in a game controller of the game playing apparatus, more particularly, a data storage element of the game controller. The data storage element may contain data for the expected values of each possible reel-stopping position of each of the remaining sub-games. Thus, the method may include storing the data in the form of look-up tables for each of the sub-games.

Once the expected value for the first sub-game has been determined, the method may include accessing the look-up tables for each of the remaining sub-games to ascertain the expected value for each of the remaining sub-games which most closely approximates the expected value for the first sub-game. Once the expected values of the remaining sub-games have been selected, the method may include determining the displayed fewer than all of the image carrying elements of the remaining sub-games and displaying the fewer than all of the image carrying elements of the remaining sub-games.

The method may include not displaying any information relating to the remaining, non-displayed image carrying elements of each of the sub-games. In other words, the positions at which the second and fourth reels of each sub-game are displayed may be left blank.

The method may include requiring a player to place a wager prior to displaying the partial outcomes of the sub-games. The method may include initially placing the wager on all of the sub-games of the game. Then, the method may include, when the partial outcomes of the sub-games have been displayed, offering the player the option of transferring the wager to one or fewer than all of the sub-games. The non-selected sub-game/s then being disabled, for example, by being faded into a background display on the display means.

If all of the sub-games are selected by the player, each sub-game may have its second and fourth reels revealed in a spinning condition which stop to determine whether or not a prize winning combination or combinations has resulted in any of the sub-games. Conversely, if only one or less than all of the sub-games is selected by the player, only the second and fourth reels of the selected games may be revealed and any prize winning combinations in the selected sub-games are paid out.

Each selected sub-game may have a feature game associated with it and the method may include, if that feature is won, playing off the feature before concluding the game. The method may include awarding the feature as a no-cost feature.

Further, the method may include triggering the feature associated with each sub-game independently of the result of a base sub-game preceding the triggered feature. Thus the feature does not depend on expected values associated with the relevant sub-game.

The method may include differentiating the features associated with the sub-games from one another.

The game may have a bonus jackpot feature associated with it, the bonus jackpot feature being a progressive jackpot feature having at least two jackpot levels and the method may include displaying an animation which indicates to the player which level of jackpot the player will win.

According to a fourth aspect of the invention, there is provided a game to be played on a gaming apparatus, the gaming apparatus having a display and being controlled by a game controller arranged to control images displayed on the display, the game comprising a plurality of sub-games constituting the game displayed on the display with, as an initial display, fewer than a full set of images of each of the sub-games being displayed to show a partial outcome of the game, the fewer than the full set of images being representative of a determination of an expected value for each of the sub-games.

A "gaming apparatus" is to be understood to include apparatus that does not require the wagering of a stake in order to play the game and further includes apparatus which is connectable to a network.

BRIEF DESCRIPTION OF SEVERAL VIEWS OF THE DRAWINGS

The invention is now described by way of example with reference to the accompanying diagrammatic drawings in which.

DETAILED DESCRIPTION OF THE INVENTION

Figure 1:
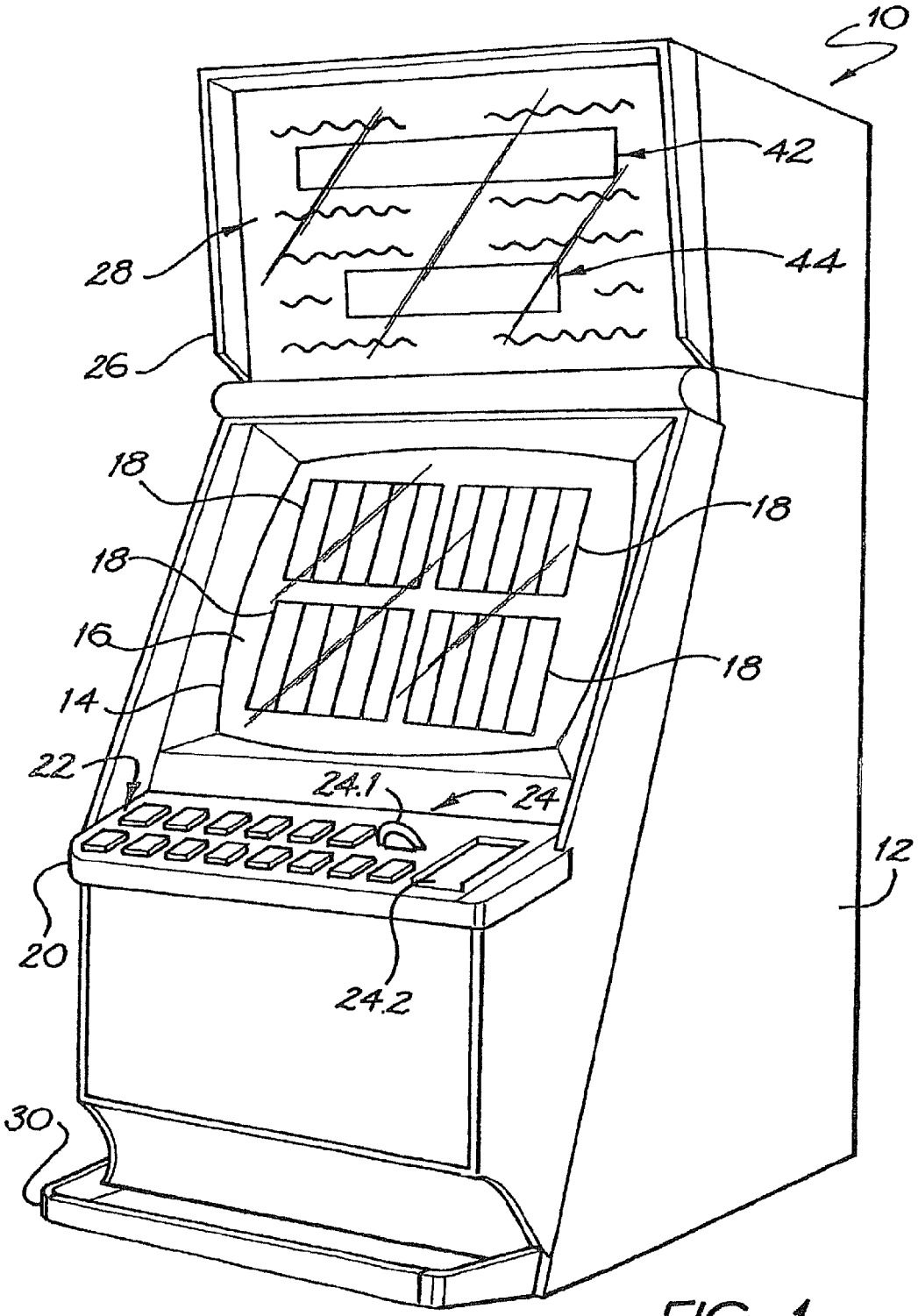
FIG. 1 shows a perspective view of a gaming machine, in accordance with the invention.

In FIG. 1, reference numeral 10 generally designates an exemplary embodiment of a gaming machine. The machine 10 includes a console 12 having a display means in the form of a video display unit 14 on which a game 16 is played, in use. The video display unit 14 may be implemented as a cathode ray screen device, a liquid crystal display, a plasma screen, or the like. The game 16 comprises a plurality of spinning reel sub-games 18. A midtrim 20 of the machine 10 houses a keypad 22 for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc. In addition, as will be described in greater detail below, the top box carries two displays 42 and 44 for a progressive jackpot bonus feature.

A coin tray 30 is mounted beneath the console 12 for cash payouts from the machine 10.

Figure 2:
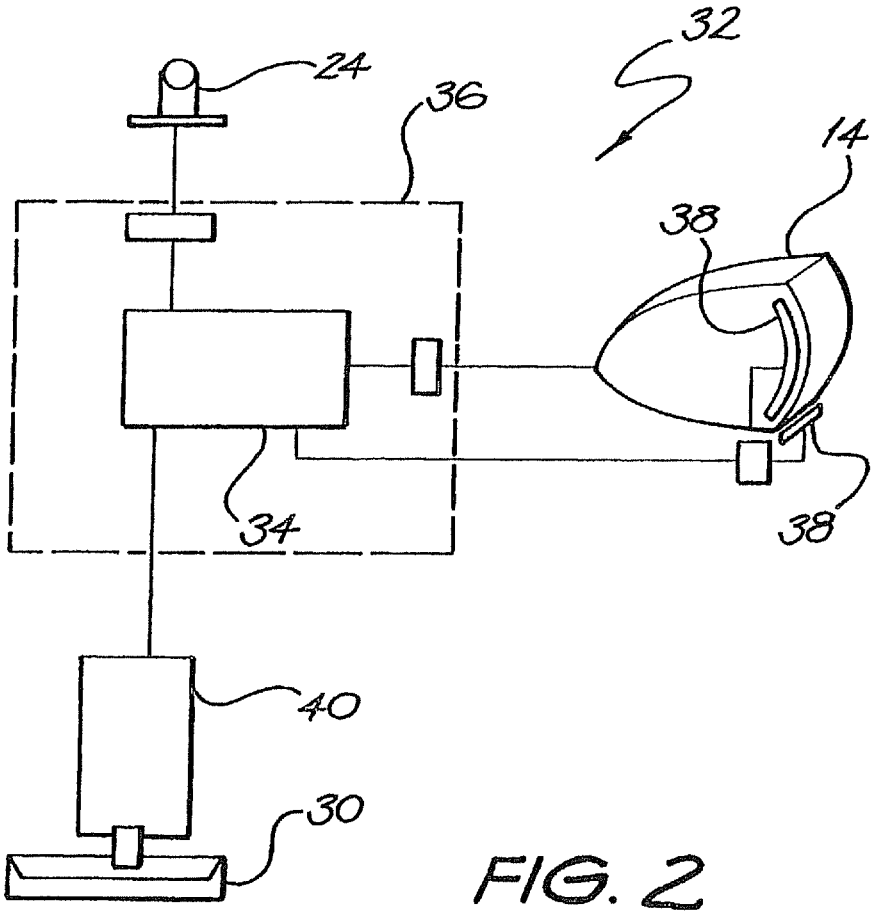
FIG. 2 shows a block diagram of a control circuit of the gaming machine.

Referring to FIG. 2 of the drawings, a control means or control circuit 32 is illustrated. A program which implements the game and user interface is run on a processor 34 of the control circuit 32. The processor 34 forms part of a controller 36 that drives the screen of the video display unit 14 and that receives input signals from sensors 38. The sensors 38 include sensors associated with the bank 22 of buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

As indicated above, the game 16 comprises four sub-games 18. Each sub-game 18 is a spinning reel-game comprising five spinning reels. The reels are displayed as simulations of spinning reels on the display of the video display unit 14.

The preferred implementation of the game 16 comprises the use of four of the Applicant's popular games. Hence, the first sub-game 18.1 (FIGS. 4-8) is the Applicant's Queen of the Nile® game, the second sub-game 18.2 is the Applicant's Penguin Pays® game, the third sub-game 18.3 is the Applicant's Dolphin Treasure® game and the fourth sub-game is the Applicant's Sweethearts® game ("Queen of the Nile", "Penguin Pays", "Dolphin Treasure" and "Sweethearts" are all registered trade marks of the Applicant).

The Queen of the Nile® sub-game is a five-reel spinning reel game where three or more scattered Pyramid symbols 46 (FIG. 4) award a feature. The feature comprises fifteen free games where all prizes are trebled. The free games can be re-triggered during the feature.

The Penguin Pays® sub-game 18.2 comprises a feature where, when a Penguin symbol 48 appears on a first reel and a background-coin symbol 50 appears on the fifth reel, a feature is awarded. During the feature a skating penguin symbol moves serially to all positions on the reels of the sub-game 18.2 and, at each position, except where a scatter symbol appears, substitutes for the underlying symbol.

The Dolphin Treasure® sub-game 18.3 has a feature where, when three or more Treasure Chest scatter symbols (not shown) appears anywhere on the display fifteen free games are awarded where all prizes are trebled. Once again, the free game feature can be re-triggered during the playing of the free games.

The Sweethearts® sub-game 18.4 has a feature which is won with any scatter win. The initial scatter win is held and the remaining reels are re-spun three times. During the respins, scatters pay in an "any" combination. Any improved scatter win is held and three free spins re-commence. The scatter symbol is a heart symbol 52.

In order to play the game 16, the player is required to place a wager. The sub-games 18.1-18.4 have been implemented as twenty line games. In order to simplify the mathematics involved, the player must place a wager of at least one bet per line on all twenty lines of each of the sub-games 18.1-18.4. Accordingly, as indicated by a bet meter 54 in FIGS. 4-6, the player has to bet a minimum stake of 80 credits.

In this regard, it is to be noted that each sub-game 18.1-18.4 has a win meter 56.1-56.4, respectively, associated with it.

The player places the wager by pressing one of four buttons 58, 60, 62 or 64 on the keypad 22. Button 58 is pressed if one bet per line is to be wagered, button 60 is pressed if two bets per line are to be wagered, button 62 is pressed if three bets per line are to be wagered and button 64 is pressed if ten bets per line are to be wagered.

The player then commences the game 16 by pressing button 66 on the keypad 22.

As an initial step, the controller 34 selects, randomly using a random number generator, reel stopping positions for the first, third and fifth reel of the sub-game 18.1. Once these reel stopping positions have been determined, and before anything is displayed on the display of the video display unit 14, the controller 34 determines the expected value arising as a result of the selected reel stopping positions for reels 1, 3 and 5 of the sub-game 18.1.

The controller 34 has a data storage device in which look-up tables for each of sub-games 18.2-18.4 are stored. The look-up table for each of the sub-games 18.2-18.4 contains expected values for all possible reel stopping positions of each of the sub-games 18.2-18.4.

Thus, once the expected value for the reel stopping positions of reels 1, 3 and 5 of sub-game 18.1 has been determined by the controller 34, the controller 34 accesses the look-up tables for each of the remaining sub-games 18.2-18.4. The controller 34 determines expected values for the remaining sub-games 18.2-18.4 which are approximately the same as the determined expected value for the sub-game 18.1. It is not necessary that the expected values for the sub-games 18.2-18.4 be exactly the same as that for sub-game 18.1 but can be slightly more or slightly less than the expected value for sub-game 18.1.

Once the expected values for the sub-games 18.2-81.4 have been ascertained via the look-up tables of the controller 34, the controller 34 selects reel stopping positions for reels 1, 3 and 5 for each of the remaining sub-games 18.2-18.4. It will be appreciated that the selected reel stopping positions for reels 1, 3 and 5 correspond to the ascertained expected values for the sub-games 18.2-18.4.

Figure 4:
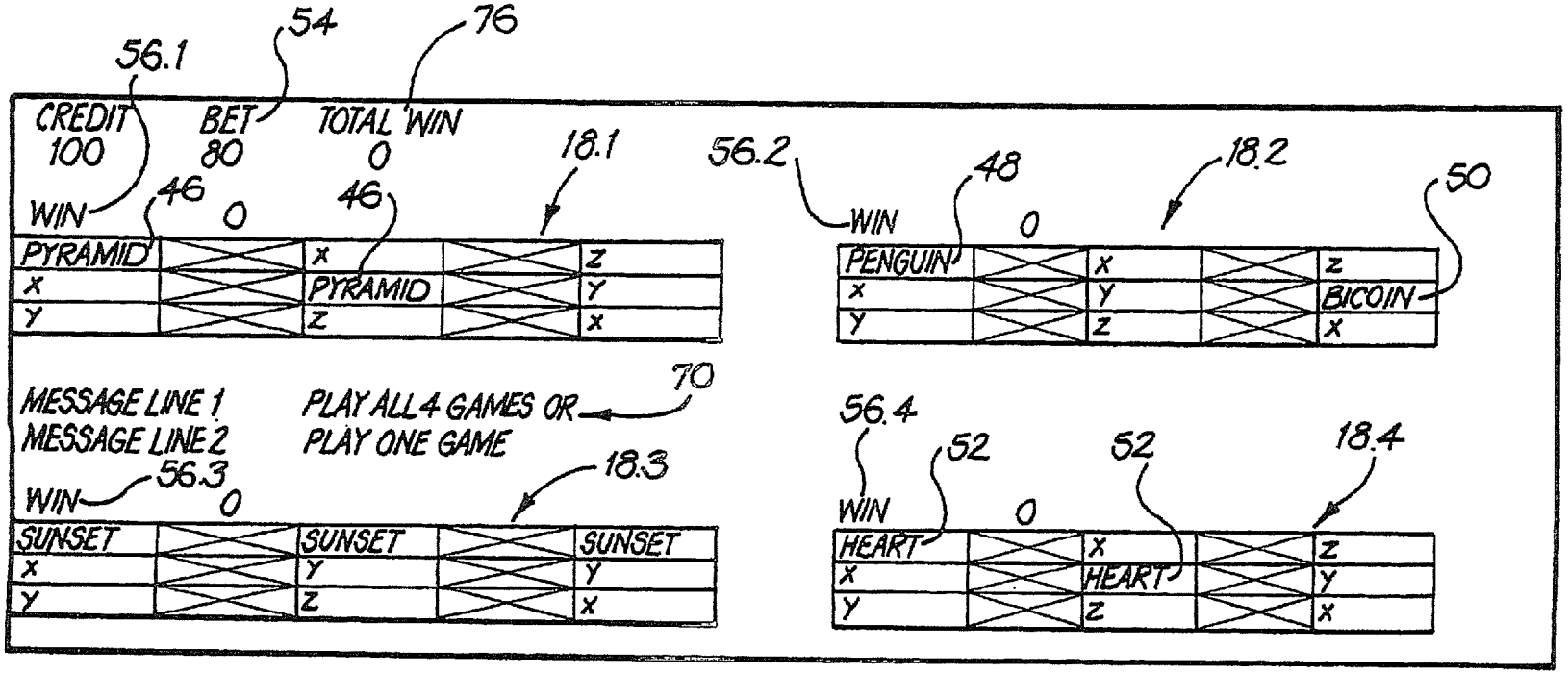
FIG. 4 shows a schematic representation of a screen display of an initial condition of sub-games constituting a game played on the gaming machine of FIG. 1.
Figure 7:
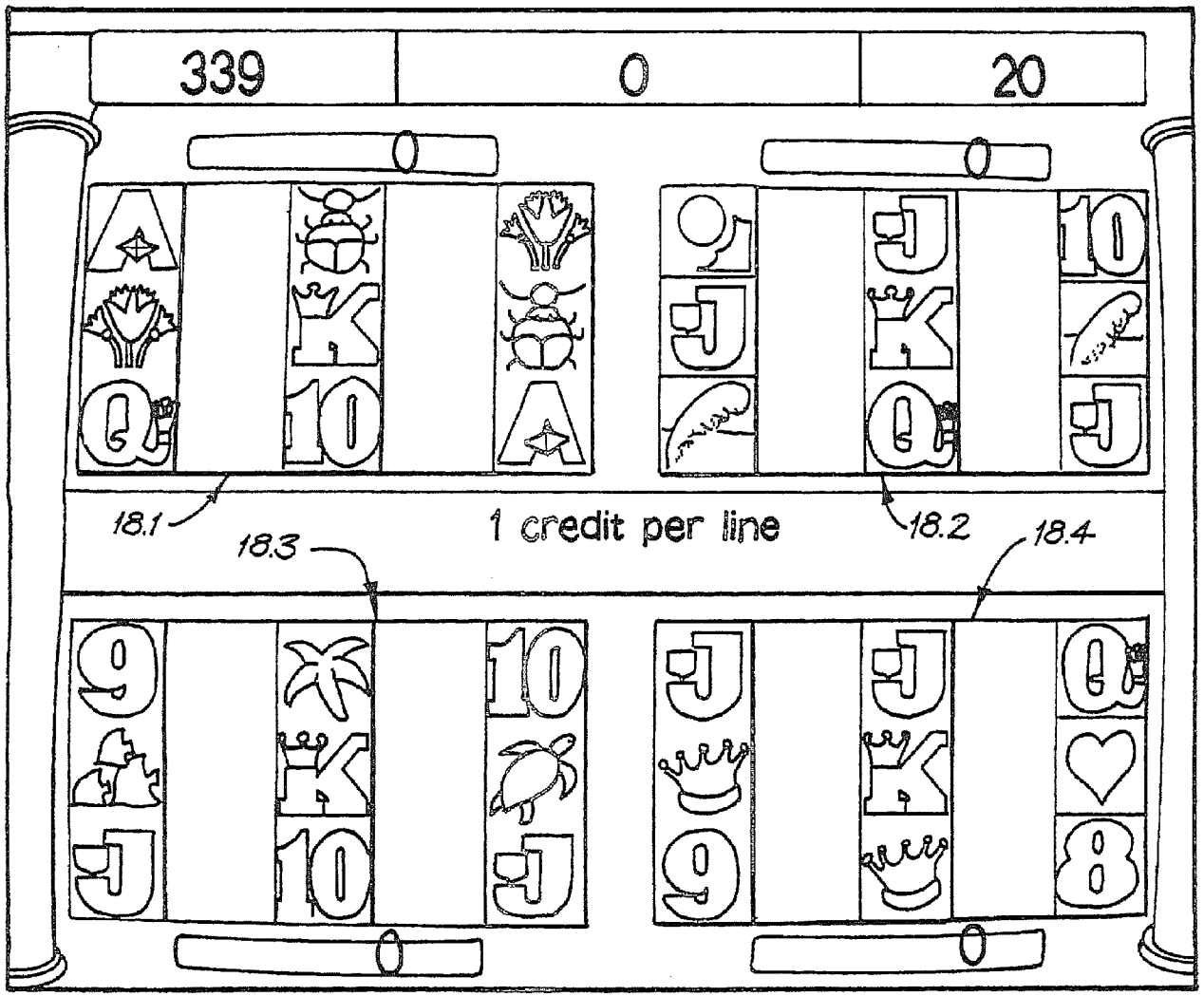
FIG. 7 shows a screen display of an initial condition of the game.
Figure 8:
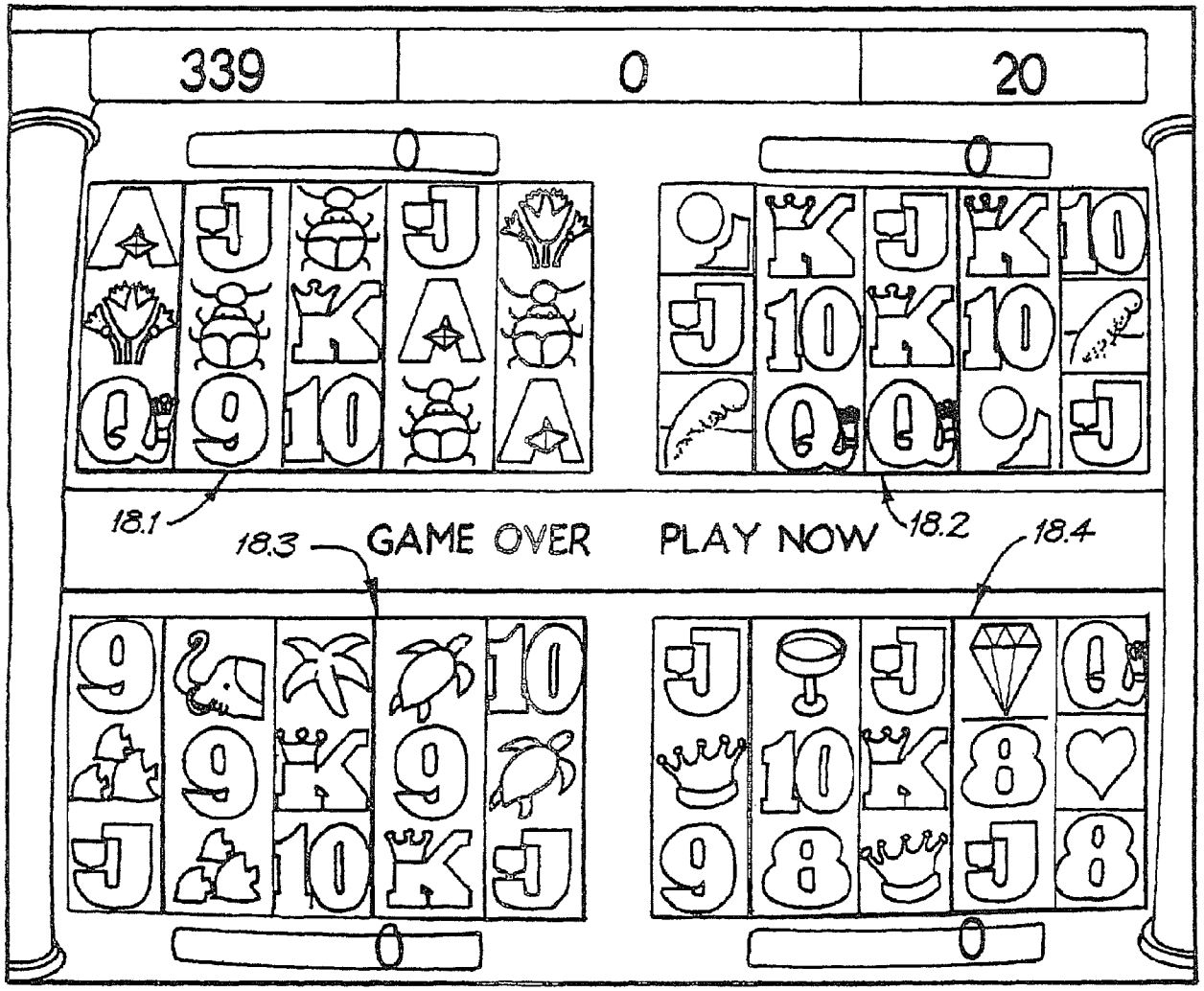
FIG. 8 shows a screen display of the final condition of the game.
Figure 9:
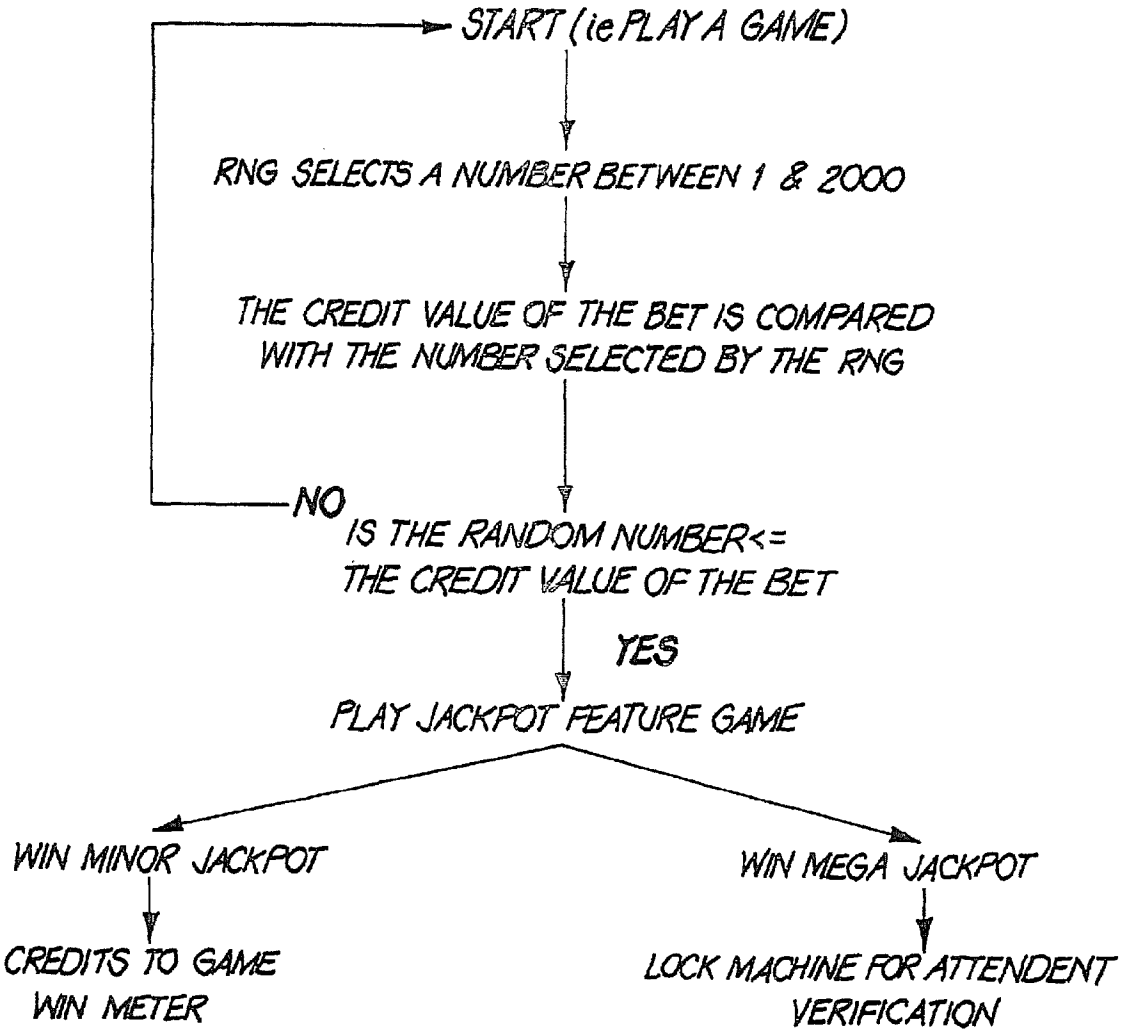
FIG. 9 shows a flow chart of a jackpot feature optionally forming part of the game.

Once these reel-stopping positions have been selected by the controller 34, the reel stopping positions of reels 1, 3 and 5 for each of the sub-games 18.1-18.4 are displayed on the display of the video display unit 14 as shown in FIGS. 4 and 7 of the drawings.

The player then has two options. The player can either elect to play all four sub-games 18.1-18.4 or any one of the sub-games 18.1-18.4. The options available to the player are displayed by way of a message 70 (FIG. 4) on the display.

Figure 3:
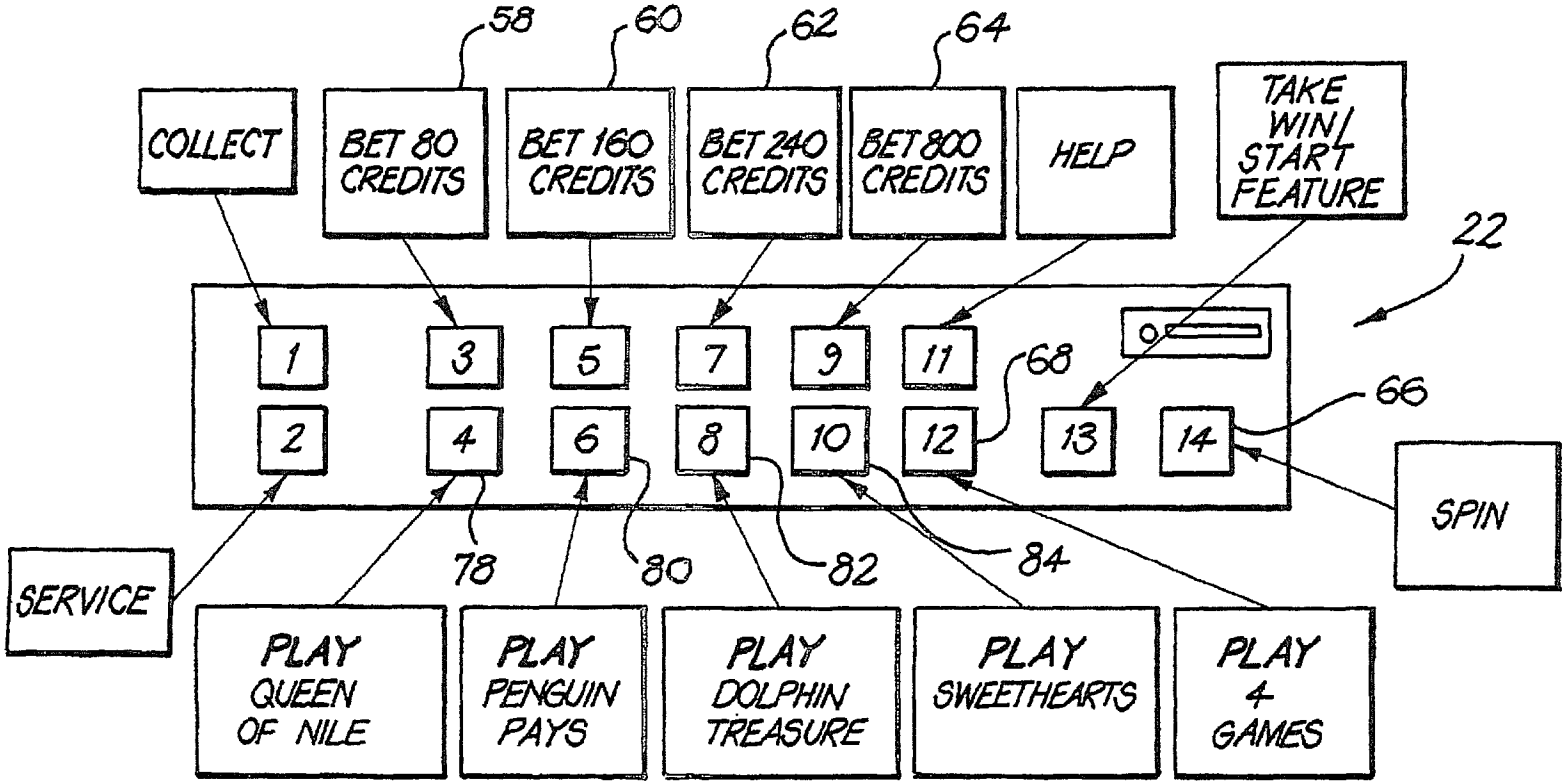
FIG. 3 shows a schematic representation of a keypad of the gaming machine.

Should the player desire to play all four games, the player presses button 68 (FIG. 3) on the keypad 22. When the player presses button 68, the second and fourth reels for each of the sub-games 18.1-18.4 become visible and spin. The second and fourth reels then come to a stop to show, for example, the result illustrated in FIG. 5 of the drawings. A message 72 is displayed showing that the player had played all four games and had bet one bet or credit per line as shown by message 74.

Figure 5:
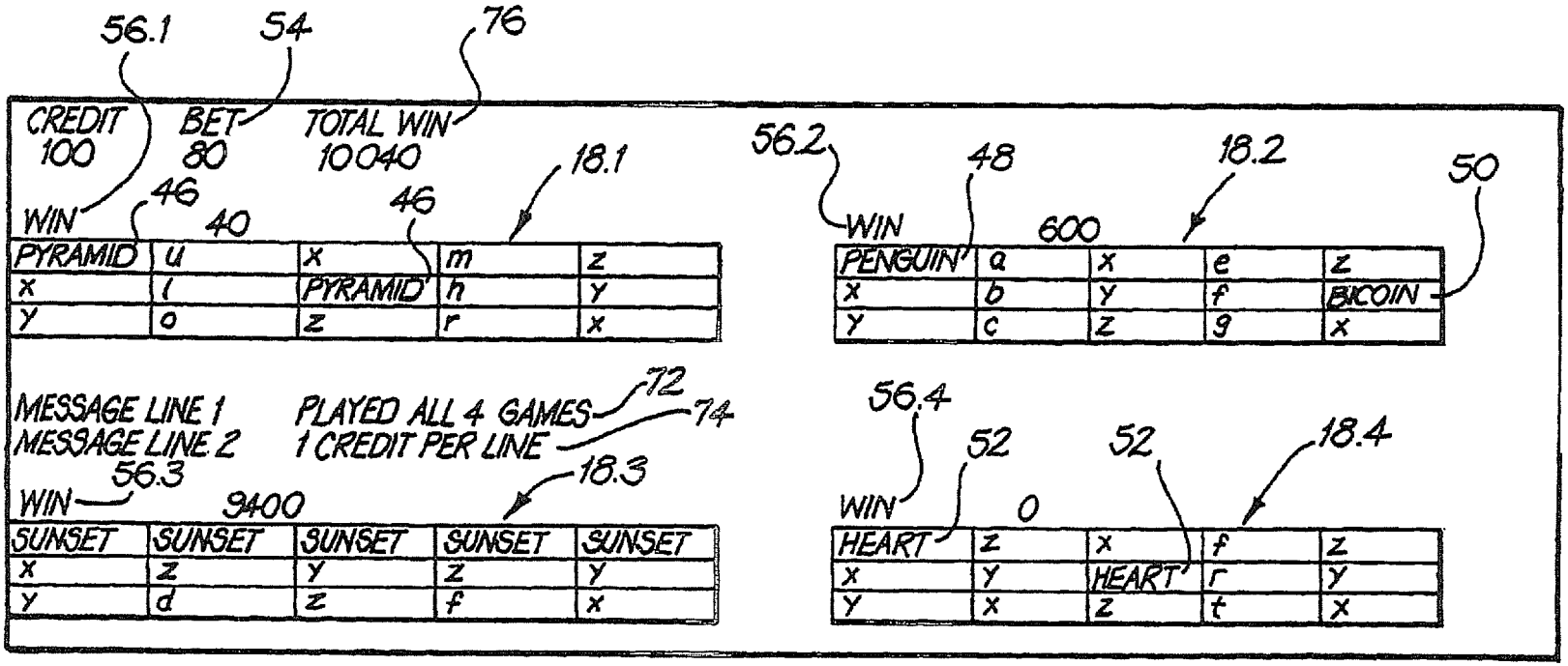
FIG. 5 shows a schematic screen display of one final condition of the sub-games of the game of FIG. 4.

In the examples shown in FIG. 5 of the drawings, the only win occurring was a prize of 600 credits as shown on win meter 56.2. However, because the trigger condition of symbols 48 and 50 was present, the player is awarded the feature associated with Penguin Pays® and a total win of 10,040 credits results as shown on the win meter 76 of the gaming machine 10.

Should the player rather desire to play only one of the sub-games 18.1-18.4, the player presses an appropriate button 78, 80, 82 or 84 associated with the sub-games 18.1, 18.2, 18.3 and 18.4, respectively.

In the example illustrated, it is assumed that the player has selected to play the Sweethearts® sub-game 18.4. The player does this by pressing button 84.

Figure 6:
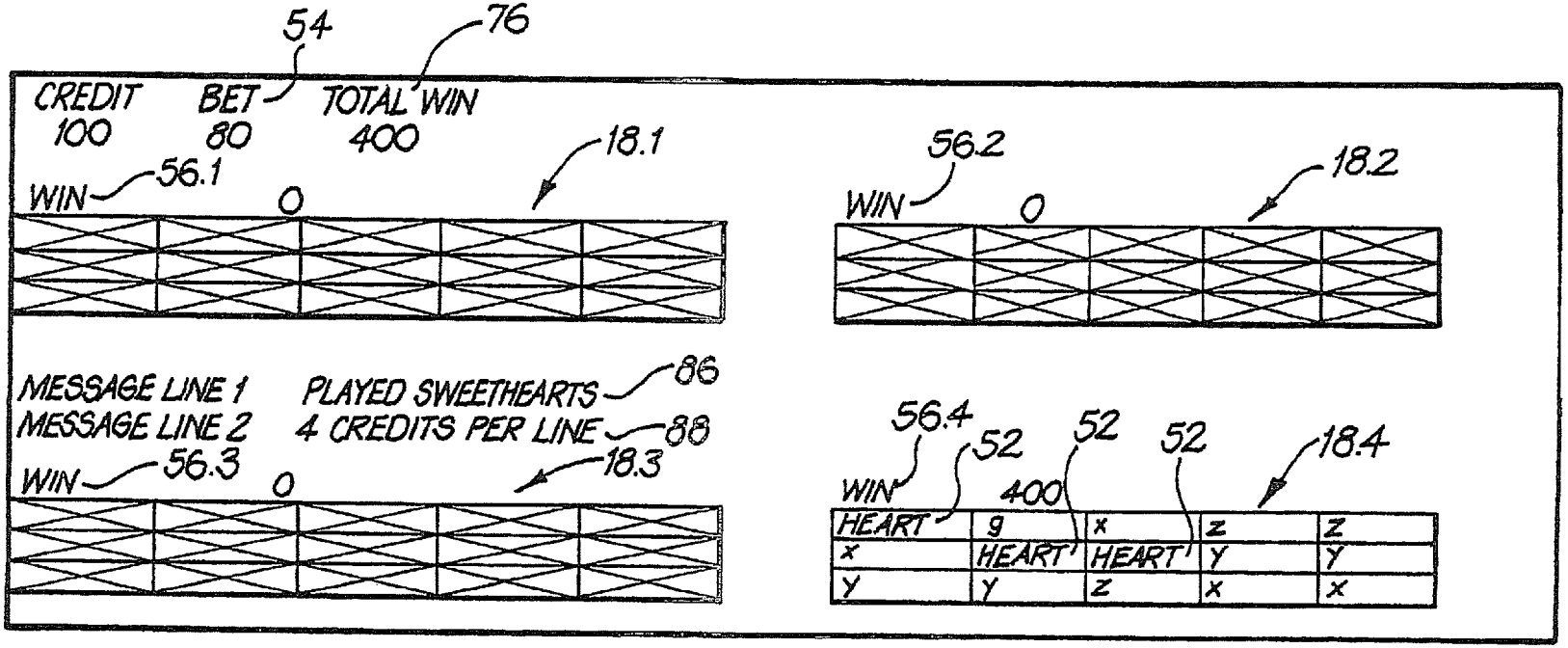
FIG. 6 shows a schematic screen display of another final condition of the game of FIG. 4.

The result of the player electing to play the Sweethearts® game is shown in FIG. 6 of the drawings. A message 86 appears advising the player that only the Sweethearts® game is being played. Importantly, the credits which had initially been bet on the other sub-games 18.1-18.3 are transferred to the sub-game 18.4 so that, as shown by message 88 four credits or bets per line are wagered on the sub-game 18.4.

The sub-games 18.1-18.3 fade into a background of the display so that only sub-game 18.4 is visible. The second and fourth reels of the sub-game 18.4 appear, spin and then come to a stop. The result, as shown in FIG. 6 of the drawings, is that three scatter symbols 52 are spun up in the sub-game 18.4 resulting in a payment of 100 credits multiplied by the number of credits per line for a total of 400 credits. The win is credited to the win meter 56.4 of the sub-game 18.4 and the win meter 76 of the gaming machine 10.

The game is then regarded as concluded and the player, in order to continue playing the gaming machine 10 must place a further wager.

The game 16 includes a progressive jackpot feature. The progressive jackpot bonus feature is a two tier jackpot game consisting of a mega jackpot, the present value of which is displayed on the display 42 of the gaming machine 10, and a minor jackpot, the present value of which is displayed on the display 44 of the gaming machine 10. The display 42 is a nine digit display and the display 44 is a five digit display.

The progressive jackpot feature can be won at random during any bought game. The chances of winning the jackpot feature are related to the size of the bet wagered. The higher the bet wagered, the greater the likelihood of winning the jackpot feature.

Figure 10:
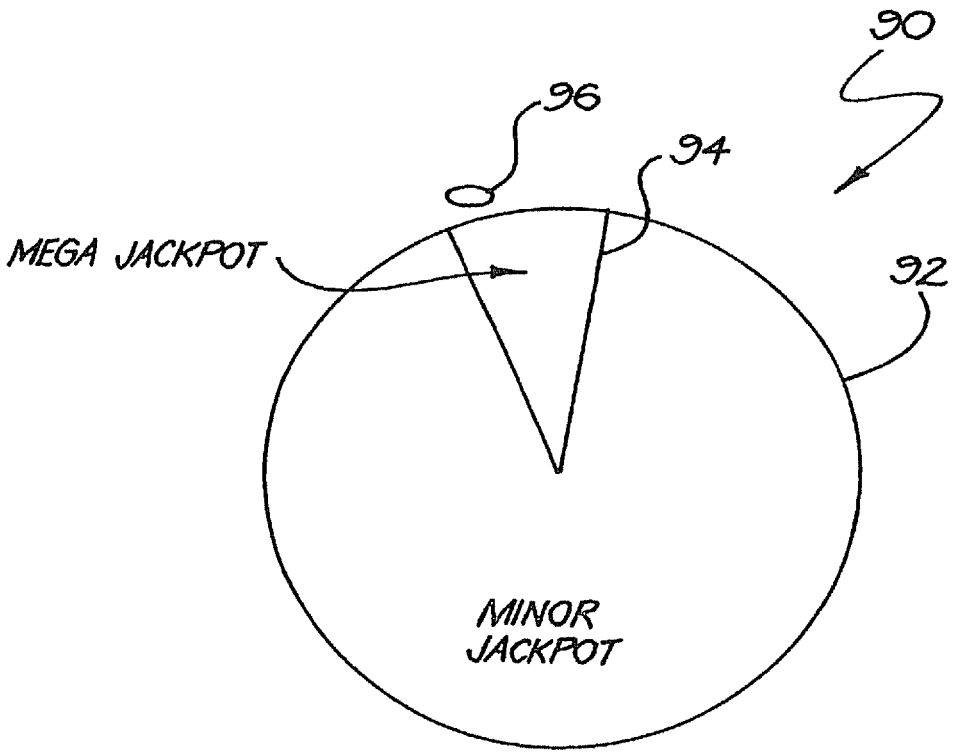
FIG. 10 shows an animation relating to the jackpot feature.

When the jackpot feature is triggered, the screen display on the video display unit 14 changes to a screen display 90 as shown in FIG. 10 of the drawings. The screen display 90 is in the form of a circle 92 having a segment 94 representative of the mega jackpot with the remaining part of the circle 92 being representative of the minor jackpot. A marker 96 rolls around the outside of the circle 92 and where the marker 96 comes to rest relative to the circle 92 determines whether the minor jackpot is awarded or the mega jackpot is awarded. If the marker 96 comes to rest opposite the segment 94 the mega jackpot is awarded. If the marker 96 comes to rest at any other positions relative to the circle 92, the minor jackpot is awarded.

The jackpot feature is awarded only once all wins and features associated with the sub-games 18.1-18.4 have been completed. A message will appear on the display prior to the display changing to the screen display 90 advising the player that, to commence with the jackpot feature, the Spin button 66 on the keypad 22 must be pressed. When this occurs, the screen display 90 replaces the display of the sub-games 18.1-18.4.

Hence, it is an advantage of the invention that a gaming machine 10 is provided having a number of games thereon which increases player interest and encourages play. It also exposes players to the Applicant's most popular games and can be used for introducing new games to players.

Use of the look-up tables ensures that the overall return to player percentage of the gaming machine 10 can be maintained at required or regulated levels.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine comprising an electronic display, a random number generator, and a game controller configured to display a plurality of separate sub-games on the electronic display, and wherein outcomes of a first of the plurality of separate sub-games is determined using the random number generator and outcomes of the other sub-games are determined by the game controller based on said outcomes of said first of the plurality of the separate sub-games, wherein the separate sub-games are playable and displayed simultaneously on the electronic display, each of the sub-games being a spinning reel game and comprising a respective plurality of paylines, wherein the number of paylines of any one of the sub-games is equal to the number of paylines of any other one of the sub-games, and wherein the game controller is further configured to receive a single wager of a predefined plurality of credits, wherein the predefined plurality of credits are selected from a set of predefined plurality of credits each comprising an equal number of credits to be wagered on each payline of each sub-game, the game controller being further configured to respond to selection of the predefined plurality of credits and to display a partial game outcome for each sub-game, the game controller being further configured to receive a selection of the plurality of separate sub-games to continue playing, and when the plurality of separate sub-games selected is less than all of the plurality of sub-games displayed, to transfer the plurality of credits of the single wager to the selected sub-games.

2. The gaming machine as claimed in claim 1, wherein the game controller is further configured to cause only one wager meter and a plurality of win meters to be displayed on the electronic display, wherein the one wager meter is used by the game controller to display a value of the single wager, each of the win meters being associated with one of the separate sub-games and used by the game controller to display a number of credits won as a result of playing the associated one of the separate sub-games.

3. The gaming machine as claimed in claim 1, wherein the predefined plurality of credits comprise a minimum credit amount corresponding to a minimum payline wager amount and at least one other credit amount that is an non-zero multiple of the minimum credit amount.

4. A method for use with a gaming machine having a controller, a random number generator, and an electronic display device, the method comprising:

displaying, via the controller, a plurality of separate sub-games simultaneously on the electronic display device, each of the separate sub-games being a spinning reel game of chance comprising a plurality of respective paylines, wherein the number of paylines for any one of the separate sub-games is equal to the number of paylines for any other one of the separate sub-games;

determining outcomes of a first of the plurality of separate sub-games using the random number generator;

determining outcomes of the other of the plurality of separate sub-games based on said outcomes of said first of the plurality of the separate sub-games via the game controller;

receiving, via the controller, a single wager of a predefined plurality of credits, wherein the predefined plurality of credits are selected from a set of predefined plurality of credits each comprising an equal number of credits to be wagered on each pay line of each separate sub-game;

responsive to selection of the predefined plurality of credits, displaying a partial game outcome for each sub-game; and receiving a selection of the plurality of separate sub-games to continue playing, wherein, when the selected sub-games is less than all of the plurality of sub-games displayed, the plurality of credits of the single wager are transferred to the selected sub-games.

5. The method as claimed in claim 4, further comprising causing only one wager meter and a plurality of win meters to be displayed on the electronic display device, the one wager meter being used to display a value of the single wager, each of the win meters being associated with one of the separate sub-games and being used to display a number of credits won as a result of playing the associated one of the separate sub-games.

6. The method as claimed in claim 4, wherein the predefined plurality of credits comprise a minimum credit amount corresponding to a minimum payline wager amount, and at least one other credit amount that is an non-zero multiple of the minimum credit amount.

7. The gaming machine as claimed in claim 1, wherein the game controller is further configured (1) to maintain the visibility of said selected number of sub-games on said electronic display, and (2) to fade the other sub-games into the background on said electronic display.

8. The method as claimed in claim 4, wherein said emphasizing includes maintaining the visibility of said selected number of sub-games on said electronic display device and fading the other sub-games into the background on said electronic display device.

* * * * *